United States Patent [19]

Comerford

[11] 4,202,234

[45] May 13, 1980

[54] DIGITAL GENERATOR FOR MUSICAL NOTES

[75] Inventor: Peter J. Comerford, Ilkley, England

[73] Assignee: National Research Development Corporation, London, England

[21] Appl. No.: 791,428

[22] Filed: Apr. 27, 1977

[30] Foreign Application Priority Data

Apr. 28, 1976 [GB] United Kingdom ..... 17276/76

[51] Int. Cl.[2] ..... G10H 1/00

[52] U.S. Cl. ..... 84/1.01

[58] Field of Search ..... 84/1.01, 1.03, 1.4, 84/1.12, 1.19, 1.21, 1.26, 1.28, 402

[56] References Cited

U.S. PATENT DOCUMENTS

| | | | |
|---|---|---|---|
| 3,515,792 | 6/1970 | Deutsch | 84/1.03 |
| 3,610,799 | 10/1971 | Watson | 84/1.01 |
| 3,743,755 | 7/1973 | Watson | 84/1.01 |
| 3,771,406 | 11/1973 | Wheelwright | 84/464 |
| 3,809,786 | 5/1974 | Deutsch | 84/1.01 |
| 3,809,788 | 5/1974 | Deutsch | 84/1.01 |
| 3,809,789 | 5/1974 | Deutsch | 84/1.01 |
| 3,809,790 | 5/1974 | Deutsch | 84/1.01 |
| 3,823,390 | 7/1974 | Tomisawa et al. | 340/172.5 |
| 3,844,379 | 10/1974 | Tomisawa et al. | 84/1.01 |
| 3,974,498 | 8/1976 | Griffith et al. | 346/166 R |
| 3,979,996 | 9/1976 | Tomisawa et al. | 84/1.25 |
| 4,003,003 | 1/1977 | Haeberlin | 332/11 R |
| 4,079,650 | 3/1978 | Deutsch et al. | 84/1.26 |
| 4,082,027 | 4/1978 | Hiyoshi et al. | 84/1.01 |
| 4,082,028 | 4/1978 | Deutsch | 84/1.27 |
| 4,085,644 | 4/1978 | Deutsch et al. | 84/1.01 |
| 4,112,803 | 9/1978 | Deutsch | 84/1.24 |
| 4,131,049 | 12/1978 | Okumura et al. | 84/1.01 |

OTHER PUBLICATIONS

"An Acoustic Compiler for Music & Psychological Stimuli"; Max Mathews, Bell System Technical Journal, May 1961.

"Sound Generation by Means of a Digital Computer"; Journal of Music Theory, vol. 7, 1963, pp. 24–71.

"The Technology of Computer Music"; Max Mathews; MIT Press; 1969.

"The Digital Computer as a Musical Instrument"; M. V. Mathews; Science, 11/1/63.

*Primary Examiner*—Vit W. Miska

*Attorney, Agent, or Firm*—Cushman, Darby & Cushman

[57] ABSTRACT

In a generator of musical notes for use as an electronic organ or other instrument, particularly of keyboard type, a computer is programmed to provide control and data signals to external hardware in response to the selection of stops and keys. In response to each change of stop a range of characteristic harmonic structures is synthesized digitally to provide single-cycle reference waveforms for storage for so long as that stop remains in use. In response to the selection of a key in that stop an appropriate reference waveform is sampled, or interpolative sampling is performed between two waveforms, so that an harmonic structure is produced by sampling which is precisely related to the position of the key in the register. The pitch of the note to be reproduced from the digital samples is determined by the rate of sampling which can be finely resolved. Samples are read at a fixed clock rate, but the number of clock intervals required to step through the single-cycle reference waveform is caused to be inversely proportional to the required pitch. Many independent notes can be produced simultaneously for audio-reproduction following digital-to-analogue conversion of the sample values.

29 Claims, 10 Drawing Figures

DIGITAL GENERATOR FOR MUSICAL NOTES

This invention relates to a digital generator for musical notes of particular application in such electronic musical instruments as the electronic organ.

Oscillators and other analogue devices have long been applied to the simulation of conventional musical instruments. Within the last twenty years the increasing use of digital techniques has prompted the application of such techniques to the synthesis of speech and musical waveforms. A technique which has been extensively reported concerns the generation by an appropriately programmed computer of a sequence of amplitude values in digital form to represent a musical composition. It was clear that in principle such a sequence could be generated, in response to a score in a suitable notation, for immediate reproduction through a digital-to-analogue converter and an audio system. As a practical matter, in order to accommodate limitations of computer speed, an intermediate stage of low-speed digital recording with higher speed relay was introduced. The essential process of generation for a notional orchestral instrument involved the sampling of a digitally represented waveform held in store in the computer and the modification of the sample values to impart the desired amplitude and characteristics of the instrument such as attack and decay. The frequency of a note played on the instrument was determined by the rate of sampling and the sampling of the stored waveform was continued for the assigned duration of the note.

It will be noted that a single permanently stored waveform served to characterise the simulated instrument over the whole of the range of frequency. Such characterisation will seldom be found in any actual musical instrument and therefore involves a departure from realism to which the ear is very sensitive. Particularly for a pipe-organ it is well established that for a given rank of pipes the harmonic structure (the distribution and relative amplitude of overtones) is characterised by the relative strength of the fundamental in notes in the treble range and the increasing strength of overtones in notes towards the bass range. It is desirable therefore that an electronic organ should provide some corresponding adaptation of harmonic structure to pitch.

According to the invention a digital generator for musical notes comprises means for producing selection signals each of which indicates the selection of a defined set of harmonic structures and means for producing further selection signals each of which indicates the selection of a note having a predetermined pitch and a predetermined harmonic structure lying within the set, digital computing means programmed to be responsive to each selection signal to produce harmonic data and control signals, storage data and control signals and sample-selection data and control signals, synthesising means responsive to the harmonic data and control signals for synthesising digital data representing at least one reference waveform, the or each reference waveform corresponding to a respective predetermined one of said defined set of harmonic structures, means responsive to the storage data and control signals for storing the reference waveform data, and sampling means responsive to the sample-selection data and control signals for selectively sampling the stored reference waveform data to derive further digital data representing the predetermined harmonic structure of the selected note, the rate of sampling being effective to determine the pitch of the note when the note is reproduced from the further digital data.

The synthesising means may include means for storing data representing a sinusoidal waveform, means for deriving harmonic data from the stored data and means for superimposing the stored data and the harmonic data to constitute the reference waveform.

The sampling means may include addressing means for addressing the reference waveform data store to determine a sample value at each selected address, the addressing means being designed to advance from an indicated address to the next higher address in response to a predetermined cumulative input count, and means for selecting addresses by providing an input count increment to the addressing means at uniform intervals of time whereby the average rate of sampling varies as the ratio of the input count increment to the predetermined cumulative input count.

The sampling means may further include means for deriving a sample value interpolated between the sample values corresponding respectively to the indicated address and the next higher address whenever the cumulative input count following an input count increment is less than the predetermined value.

The sampling means may further include means for deriving a sample value interpolated between the values determined for corresponding addresses from stored data representing a pair of reference waveforms having related harmonic structures whereby digital data is generated which corresponds to a musical note having an harmonic structure intermediate between the related harmonic structures.

The sampling means may include a plurality of sampling channels from each of which said further digital data is generated and adding means for superimposing that further digital data which corresponds to a predetermined period of time in each channel, to produce digital data representing a composite waveform.

The sampling channels may be operated sequentially and the adding means may include delay means to enable that data which corresponds to sequential elements of said predetermined period of time to be superimposed.

The adding means may further include means for assigning a respective value on a scale of relative amplitude to the data from each channel, prior to superimposing the data.

The adding means may further include normalising means in which the digital data representing the amplitude at each of the sample points constituting the composite waveform is normalised to enable the most significant portion of the data to occupy a minimum number of bits.

The digital generator may include conversion means responsive to relevant ones of the data/control signals for converting the digital data representing a composite waveform to an analogue signal.

The conversion means includes means for restoring in the analogue signal the scale of relative amplitude originally assigned to that digital data which has been normalised.

The digital generator may include means for audio reproduction of the analogue signal.

In one form of the invention an electronic organ comprises a plurality of stops and keys operative to produce the selection signals and the further selection signals and a digital generator as defined according to the invention in a preceding paragraph, including at least the means described for producing digital data representing a composite waveform, means for converting such digital data to an analogue signal and means for audio reproduction of the analogue signal.

Having thus broadly described the principal features of the invention it will be clear that significant departures in design philosophy have been made from the computer music generator described in the introduction to this specification. First, each note in a given stop is generated with a harmonic structure specific to that note and the limitations of a pre-loaded waveform are avoided. Second, it has been recognised that efficient use of the computing facility is only secured by avoiding the need to generate ab initio repetitive number sequences such as are required to define a sustained note. The provision of hardware for intermediate storage of waveforms is found to allow great versatility with enhanced speed of operation.

An embodiment of the invention will now be described with reference to the accompanying drawings in which.

Figure 1:
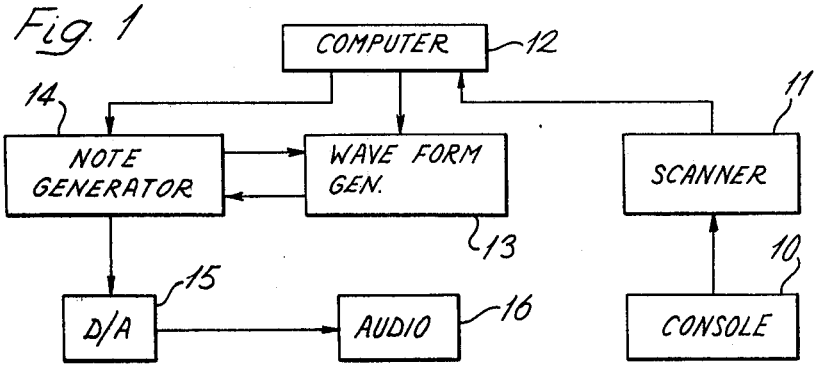
FIG. 1 is a block diagram of an electronic organ in accordance with the invention.
Figure 4:
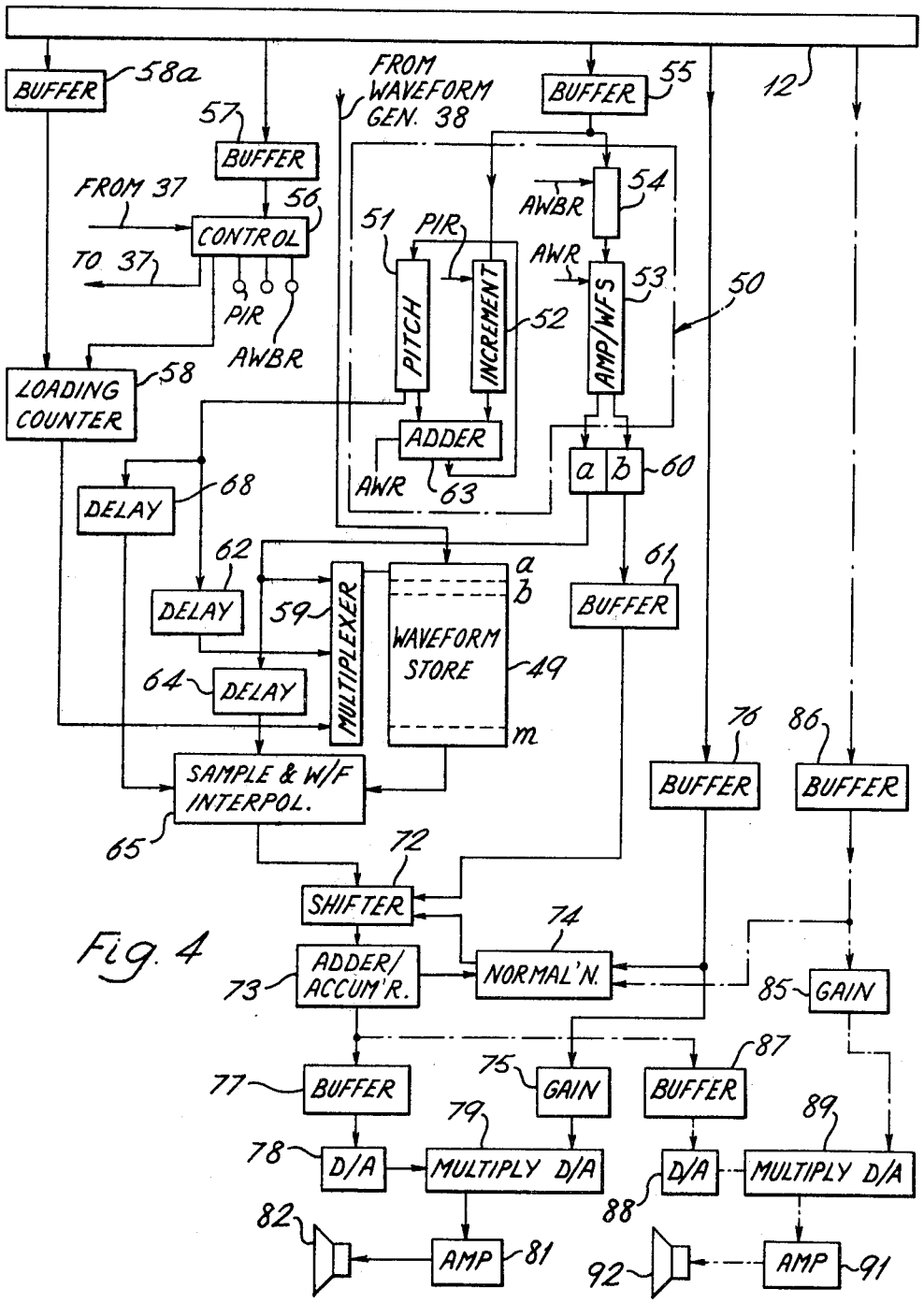
FIG. 4 is a schematic diagram of a musical note generator for the electronic organ of FIG. 1.
Figure 5B:
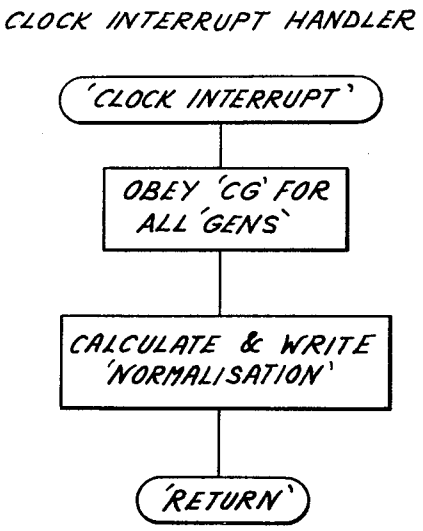
Figure 5A:
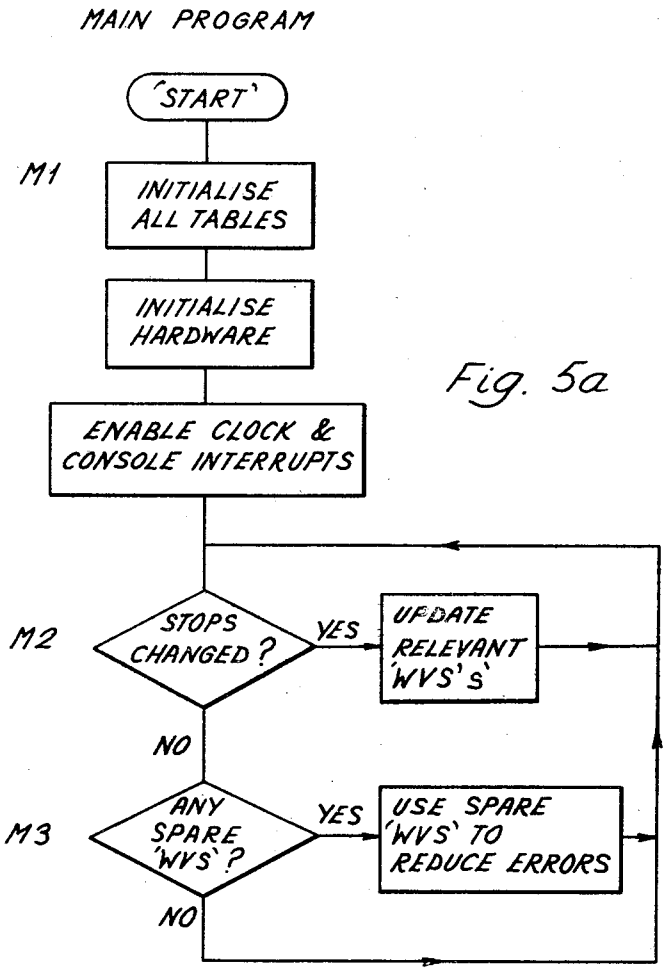
Figure 5C:
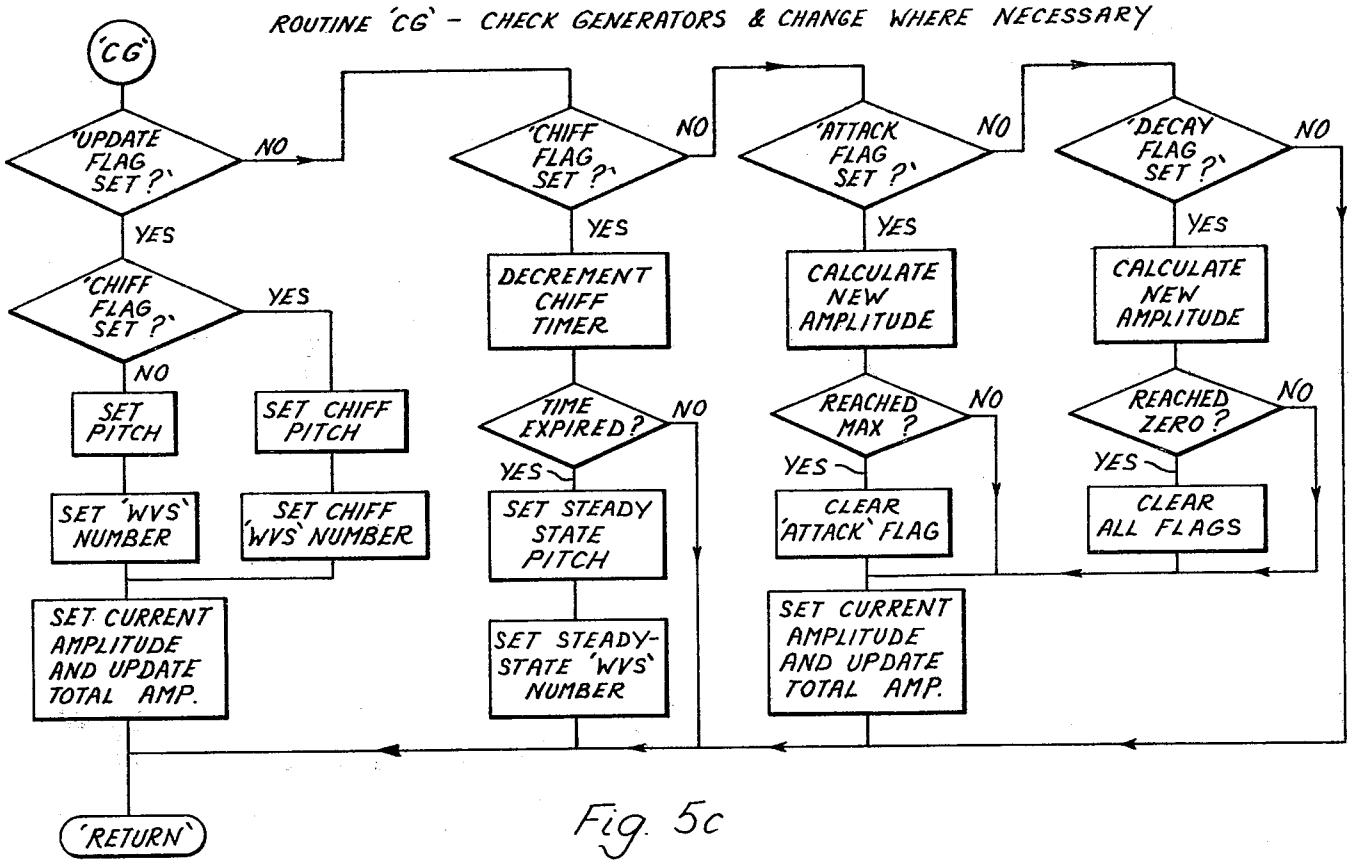
Figure 5E:
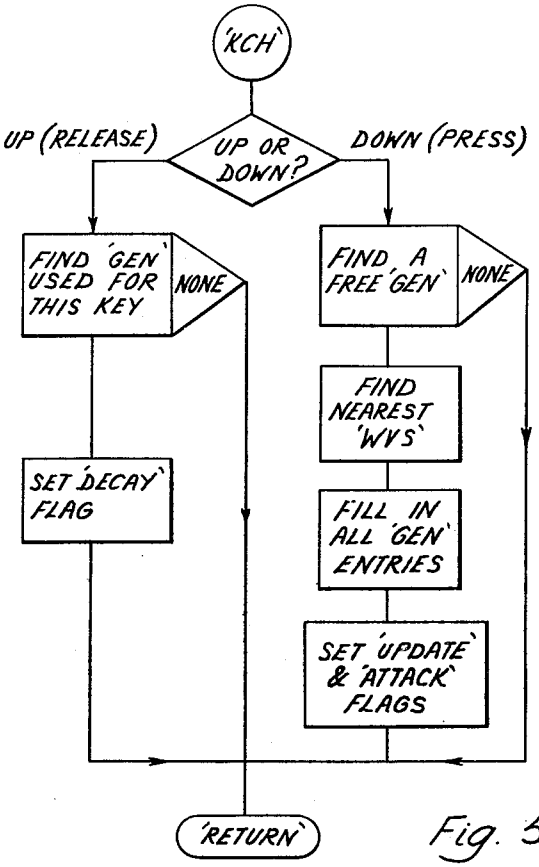
Figure 5D:
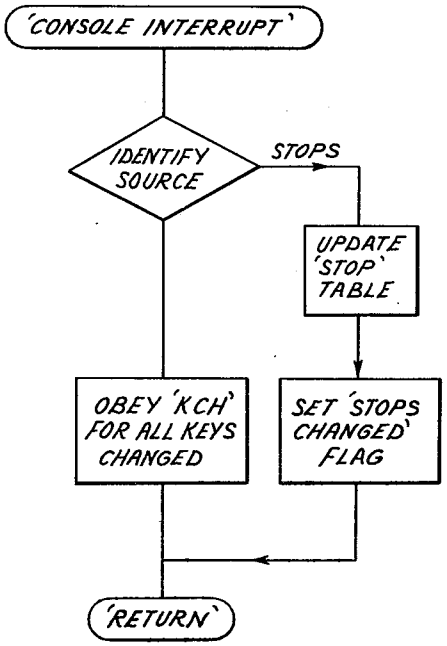
Figure 6:
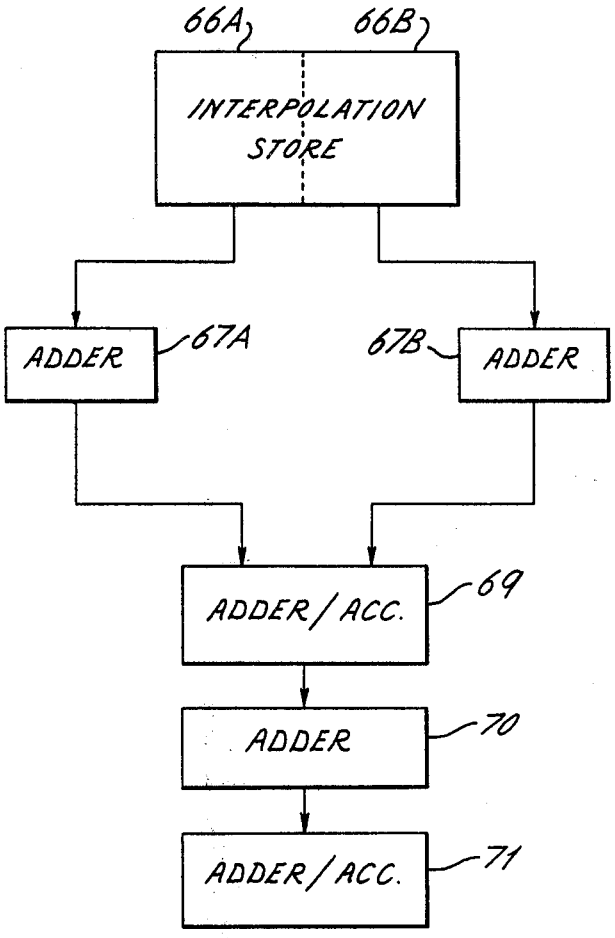

FIGS. 5*a* to 5*e* are flow diagrams of the computer shown in FIG. 1; and FIG. 6 is a schematic diagram of an interpolation unit for the generator of FIG. 4.

With reference to FIG. 1 a system operative as an electronic organ in accordance with the invention will first be considered in outline. A console 10 comprises, in conventional form, two manual keyboards and a pedal keyboard, each with associated drawstops. Couplers are also used which have the effect, for example, of causing corresponding keys on different keyboards or octave-related keys to operate together when any one of them is operated. The operation of a drawstop, in a pipe organ, is to make ready a rank of pipes chosen to define a distinctive set of harmonic structures. When a key is pressed at least one pipe of the set which relates to a notation of that key is brought into action; the fundamental pitch may correspond to the notation of the key which was pressed or may be displaced from it in some harmonic relationship. As was noted earlier in this specification, it is also characteristic of an organ that, for a given stop, the bass range of the set of pipes is built to introduce strong overtones while in the treble range the fundamental predominates and the higher overtones are suppressed.

The simulation of this process therefore first requires the issue of a selection signal from the console to indicate a change in the identity of a key or stop which is in use. The selection of a stop defines a set of harmonic structures to cover the progressive variation of tonal quality over the keyboard. The selection of a key identifies both the required pitch and the correct harmonic structure within the set. The synthesis of an appropriate complex waveform and its reproduction at the required fundamental pitch can then be instructed. In the present invention these requirements have been satisfied by a combination of a programmed computer and associated hardware. As shown in FIG. 1 a key and stop scanner 11 is provided which reviews the status of all the switch contacts which represent keys and stops and passes an appropriate selection signal to a computer 12 when any change of status is detected. In response to a selection signal instructions in the form of control/data signals for synthesising a waveform having the desired harmonic structure are issued by the computer 12 to a digital waveform generator 13. When synthesis is complete the waveform is transferred to storage in a musical note generator 14. Instructions are then issued by the computer 12 to the generator 14 to sample the stored waveform at the rate required to assign the desired fundamental pitch to the note. Further instructions cause the amplitude of the sample values to be set. The output from the generator 14 represents the desired note in digital form which is converted to analogue form in a digital-to-analogue converter 15 before passing to a conventional audio output stage 16. In general the stage 16 will comprise only an amplifier and loudspeaker. Initially the operation of the system of FIG. 1 will be described on the basis as indicated above that whenever a new selection signal is produced a corresponding waveform is synthesised ab initio in the generator 13. This process is completely valid but a modified procedure to be described later in the specification is preferred in practice as being more efficient.

Figure 2:
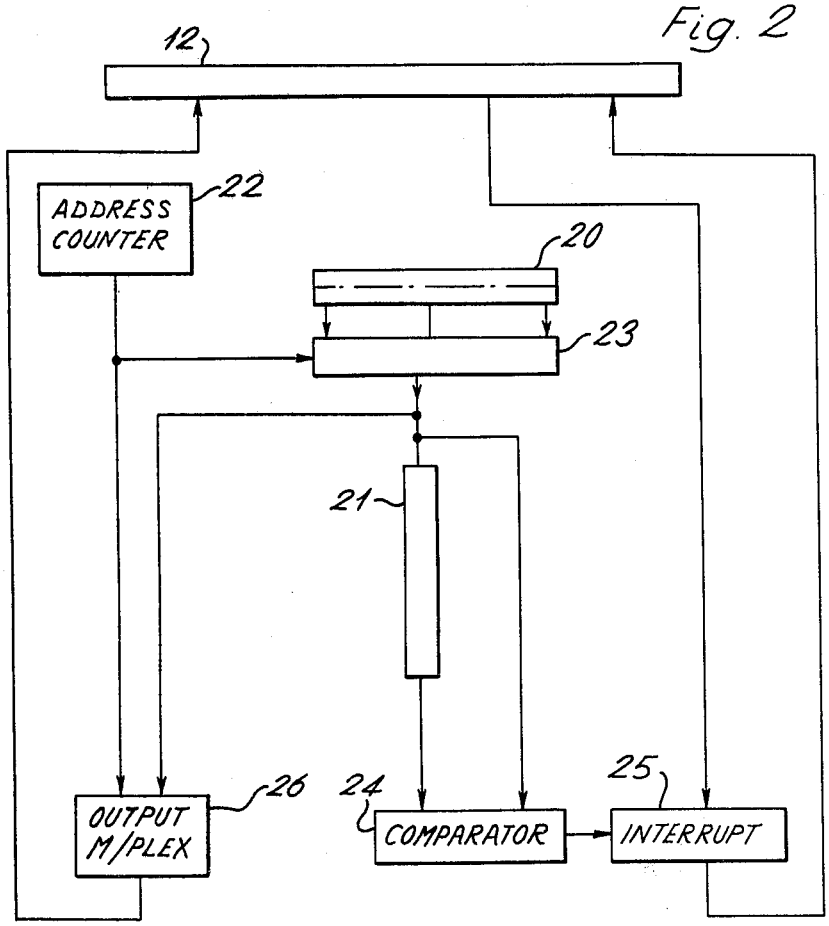
FIG. 2 is a schematic diagram of a contact scanner for the electronic organ of FIG. 1.

The construction and operation of the units of the system shown in FIG. 1 will now be considered in more detail. FIG. 2 shows the schematic circuit of the key and stop scanner 11 (FIG. 1). Contacts for all the keys, stops and auxiliary controls provided in the console 10 (FIG. 1) total about 250 and form an array 20. The number of contacts is of course dependent on the size of the instrument. The address and status of each contact of the array 20 is stored in a 512-bit shift register 21 and the array 20 is scanned for any change in status by a scanner comprising an address counter 22 and a multiplexer 23. A simple OR-gating arrangement is used so that the key contacts respond to the operation of inter-manual and manual-to-pedal couplers. It is not normally necessary therefore to include the status of couplers in the scanning process but provision may be made to do so. The register 21 is updated with the current status of each contact by the output from the multiplexer 23 and at the same time the current status is compared at a comparator 24 with the status held in the shift register 21 from the previous scan. If there is a difference the output from the comparator 24 causes an interrupt signal to pass to the computer 12 from an interrupt circuit 25 and the scan stops automatically. Via a data output multiplexer 26 the computer then reads the address of the bit at which the change has occurred and the value of the change. The scan is then resumed on computer command. Each contact is addressed during a 20 $\mu$s period and the updating of the register therefore requires a total scan time of about 10 ms with additional time dependent on the number of contact changes.

The response of the computer 12 to scan data indicating that a change in the console selection signal has been made is to draw upon the appropriate program for the synthesis of the required complex reference waveform in the waveform generator 13 (FIG. 1). The operation of the generator 13 will be understood from the schematic circuit of FIG. 3 which shows the component units of the generator 13. Waveform data is held in two stores 30*a* and 30*b* each of which provides capacity for 512 sample points with the amplitude at each point represented by up to sixteen bits. Store 30*a* is a programmable read-only memory (PROM) having a multiplexed output and Store 30b is a random-access memory (RAM). Initially, a single sinewave cycle is loaded from the computer 12 into store 30a, to provide a source from which the reference waveform is built up. In order to assign an amplitude factor to the fundamental of the complex waveform, the required amplitude is set by the computer 12 in a harmonic amplitude latch 33, a count of '1' is set on a harmonic counter 34 and a 'generate' command is issued. The sinewave sample positions are stepped through once and the output values passed to a multiplier 35 where they are multiplied by the amplitude factor stored in the harmonic amplitude latch 33. The output from the multiplier 35 is added in an adder 36 to the contents of the store 30b (zero at this stage) and recirculated to the input of the store 30b. If the waveform is to include a second harmonic, the harmonic counter 34 is set to a count of '2', the required amplitude set in the harmonic amplitude latch 33 and the 'generate' command again issued. The sinewave sample positions in store 30a are now stepped through twice, alternate positions being omitted, so that two cycles of the sinewave are represented by the same number of samples as was the fundamental. As before, each sample is multiplied by the amplitude factor, the result added to the value of the corresponding sample position derived from store 30b and the total recirculated into the store 30b. The procedure is repeated, the total number of samples being always the same, for each desired harmonic until a single cycle of the complete complex reference waveform has been generated. It will be explained later in this specification that an advantage arises if the slope of the waveform at zero-crossings is made as small as possible. This can be done by adding each harmonic or selected harmonics with 180° phase shift. An input from the computer 12 to a control and read/write counter 37 then initiates a process by which the waveform is read from the store 30b to a waveform store of the musical note generator 14 (FIG. 1). The timing of the read-out is controlled by a further input to the counter 37 from a control unit 56 of the generator 14. The store 30b is thus freed for the generation of another waveform.

The time taken for a single harmonic to be generated from a reference sinewave having 256 sample points is 256 μs. A complex waveform including ten harmonics therefore requires 2.56 ms for completion in addition to the computer processing time. Optionally the complex waveform can be limited to 128 points, or increased to 512 points.

The waveform store to which the reference waveform is transferred is of smaller capacity than store 30b and during transfer via a normalising unit 38 the 16-bit output is normalised for 12-bit storage. This is a process by which the digital values of all sample points in the waveform are shifted by the same number of bits as far to the left as is possible without overflow of the largest value; the permissible amount of shift is determined when the generation of the reference waveform is completed. The process ensures that only the least significant bits (if any) will be excluded from the 12-bit store.

The musical note generator 14 is shown in detail in FIG. 4. Corresponding to the store 30b of the waveform generator 13 is a 256×12 bit waveform store 49a which receives a completed complex reference waveform from the store 30b. The store 49a and up to thirty-one similar stores 49b–m enable thirty-two different waveforms to be retained. The function of the note generator 14 is to provide facilities under the control of the computer 12 for reading any selected stored waveform in such a way that a note of the desired pitch is reproduced at the desired relative amplitude. The data relating to each note is derived in a separate channel so that the number of notes which can be produced simultaneously is limited only by the number of such channels, which can be much greater than the number of stores. In the present example there are forty channels in which, from the particular thirty-two waveforms held at any instant in the stores 49a–m, forty notes independent in pitch and amplitude can be derived. The group of components of the generator 14 which provides these forty channels is shown in FIG. 4 enclosed by a chainline 50. Each sampling channel is allocated a separate sub-cycle of the cyclic period of the system; at subsequent points in the circuit, the resultant data is processed sequentially in a single channel.

Each of the forty channels includes a 24-bit pitch counter 51 and an associated 24-bit pitch increment register 52 which together achieve the desired rate of read-out from the selected one of the waveform stores 49. The selection of the waveforms store to be sampled and the amplitude factor to be assigned are controlled for each channel by an amplitude and waveform register 53 synchronised with the registers 51 and 52. Each register 53 has a capacity of twenty-six bits; nineteen of these define sampling data including the address(es) of the waveform store(s) 49 to be used and the remaining seven define a logarithmic sequence of amplitude scaling factors. Each register 53 is loaded from the computer 12 in response to an output from an adder 63 via an identical buffer register 54. Such a buffer is necessary to provide temporary storage for intended changes in amplitude scaling factor or in the selection of a waveform store, since it is essential that they are put into effect only when the waveform is being sampled at or near a zero-crossing at the beginning of the cycle. Unpleasant transients may be produced if changes are made at other points. The occurrence of the desired zero-crossings is detected automatically by known means (not shown in FIG. 4) in order to control the release of data from the buffer 54. Since distortion is avoided only if a sample position selected as a change point is of small magnitude, if not exactly zero, it is desirable that the slope of the waveform close to the zero-crossing should be minimised. This can be achieved during the generation of the reference waveform in the store 30b by appropriate 180° phase shifting in the addition of constituent harmonics.

Data inputs from the computer 12 are made to the buffer register 54, and to the pitch increment register 52 via a 24-bit buffer register 55. The loading of these data inputs is controlled by the computer 12 through a control unit 56 connected via a 4-bit buffer register 57. For simplicity the connections between the control unit 56 and the registers 52 and 54 are omitted from FIG. 4, the terminal points being indicated respectively by the initial letters PIR and AWBR. A further function connected through the unit 56 is the control of the transfer of a newly generated reference waveform from the store 30b (FIG. 3) to one of the stores 49. This function is performed by a waveform loading counter 58 the output from which is directed to a store address multiplexer 59 to cause reference waveform data to enter the appropriate area in the store 49. The area is identified by a control signal input to loading counter 58 via a buffer 58a.

The operation of the generator of FIG. 4 will be illustrated first by considering the way in which a waveform held, for the time being, in store 49*a* can be reproduced (digitally at this stage) at any desired pitch. An instruction to select store 49*a* for sampling is input to the register 53 together with the amplitude instruction. The store selection information is separated from the amplitude information in the output from register 53 and is passed via a delay buffer 60*a* to the store address multiplexer 59. Amplitude control data output from the register 53 is passed via a delay buffer 60*b* to a buffer 61 and is used later in the system. The sequence of operations which then determines pitch in a single reading channel is as follows.

Suppose the pitch counter 51 to be at the start of a reading scan of all the 256 sample positions representing a single cycle of the waveform held in store 49*a*. The counter 51 is connected to the store address multiplexer 59 via a buffer 62, the top eight bits of the counter 51 being used to address and read the required sample. The address held by the top eight bits of counter 51 is advanced by incrementing the lower stage of the counter 51 from the pitch increment register 52. One sample will be read during the sub-cycle period of the system (about 800 ns) which is available in sequence to each reading channel once in each complete cycle of the system (about 32 $\mu$s). If each of the 256 samples is read in turn at this rate the single-cycle waveform will be completely scanned in about 8.2 ms and the pitch of the note to be reproduced will be close to 122 Hz. This value will be referred to as the basic pitch. Clearly if only alternate samples are taken but at the same stepping rate of one sample per sub-cycle the resultant pitch will be double the basic pitch; if every third sample is taken the pitch will be trebled and so on. The limit of validity of the sampling process corresponds to only two samples per cycle when the pitch would be 15.6 KHz. This value represents a very satisfactory limit in relation to the frequency range of the ear. For lower frequencies the stepping rate must be slowed down, so that for example each successive one of the 256 samples is read only on every fourth sub-cycle, to give a pitch of 30.5 Hz.

The rate of stepping, since the time intervals are equal, is determined by the size of the increment received by the lower stage of counter 51 in each sub-cycle. During each sub-cycle the store 49*a* is addressed and read in accordance with the address held in the delay buffer 62, this address having been received from the pitch counter 51 at the start of the previous sub-cycle. Simultaneously the current state of the top eight bits of the pitch counter 51 is output to the buffer 62 and the counter 51 is updated by a new increment from the pitch increment register 52. On considering the incrementation process in more detail it will be clear that, although only the derivation of integral ratios of pitch was illustrated in the preceding paragraph, any non-integral ratio can as easily be produced. Initially a value of input count increment set by the computer 12 is loaded into the pitch increment register 52. This quantity is added to the contents of the pitch counter 51 in a 24-bit adder 63 the output from which is returned to the input of counter 51. In the counter 51 the lower sixteen bits represent a predetermined cumulative input count which must be satisfied before the waveform store address which is indicated in the top eight bits of counter 51 can be advanced to the next higher address.

It will be appreciated that a sixteen-bit increment store is used to provide very fine discrimination in the pitch ratio. For purposes of explanation however the numerical steps followed in the next paragraph will be simplified by considering only a ten-bit increment store.

A cyclic increment of 1024 will just fill a 10-bit stage each time and cause the address stage of the pitch counter to step to the next higher address. This is the basic frequency condition. A cyclic increment of 512 will only fill the 10-bit stage after two cycles so that the stepping rate, and the pitch, is halved. If now the cyclic increment is slightly reduced below the basic rate to (say) 992, the first increment will not fill the 10-bit stage and no step will occur in the address stage. On the second increment the 10-bit stage will overflow to cause a single step in the address stage and the lower stage will be partially refilled. On each subsequent increment a step occurs with reduced refilling until the number of increments becomes equal to $1024/(1024-992)=32$ when there is no refilling. The starting condition is then repeated and on the thirty-third increment no step occurs. Thirty-two steps in the address stage have therefore required thirty-three increments. The average sampling rate (i.e. number of address steps/increment) is then equal to 32/33 times the basic rate and the resultant audio frequency is similarly reduced by $1/33\times122$, or just less than 4 Hz. The use of a 10-bit increment store permits a resolution of 1/1024 in frequency which corresponds to about 0.12 Hz or 1/60th of a semitone at the basic pitch of 122 Hz. The resolution attainable with the sixteen-bit store of counter 51 is therefore very high. Programmed variations in increment may be used to produce vibrato or the effect of random pitch variation which might be found in a pipe organ.

It is a feature of the method of incremental sampling described above that the pitch of the note produced is determined by the average rate of sampling. The rate is uniform only for harmonics and sub-harmonics of the basic pitch and at all other values a periodic irregularity must appear in the time interval between adjacent sample addresses. Thus in the example discussed the first and thirty-third increments failed to advance the sample address and if the slope of the reference waveform were changing rapidly at these points the next increments would produce unusually large steps in the sample value. This irregularity is a form of digitising error in the sample address which occurs whenever the pitch counter 51 receives an increment which is neither a multiple nor a sub-multiple of the increment store capacity. It has been shown that an address increment will occur in response to an exact filling of the increment store only for basic pitch and its harmonics. More commonly there will be a significant residual count in the increment store so that it may be said that the true address lies between the indicated address and the next available one. In the basic stepping arrangement described only the indicated address was read during a sub-cycle period but the speed of operation is such that the next address can also be read during the same sub-cycle. It then becomes possible to employ a linear interpolation technique which provides a weighted value between the two sample values represented by these addresses and substantially eliminates the digitising error. Interpolation is carried out in a unit 65 which receives the sampling output from the store 49. The operation will be described later.

Figure 3:
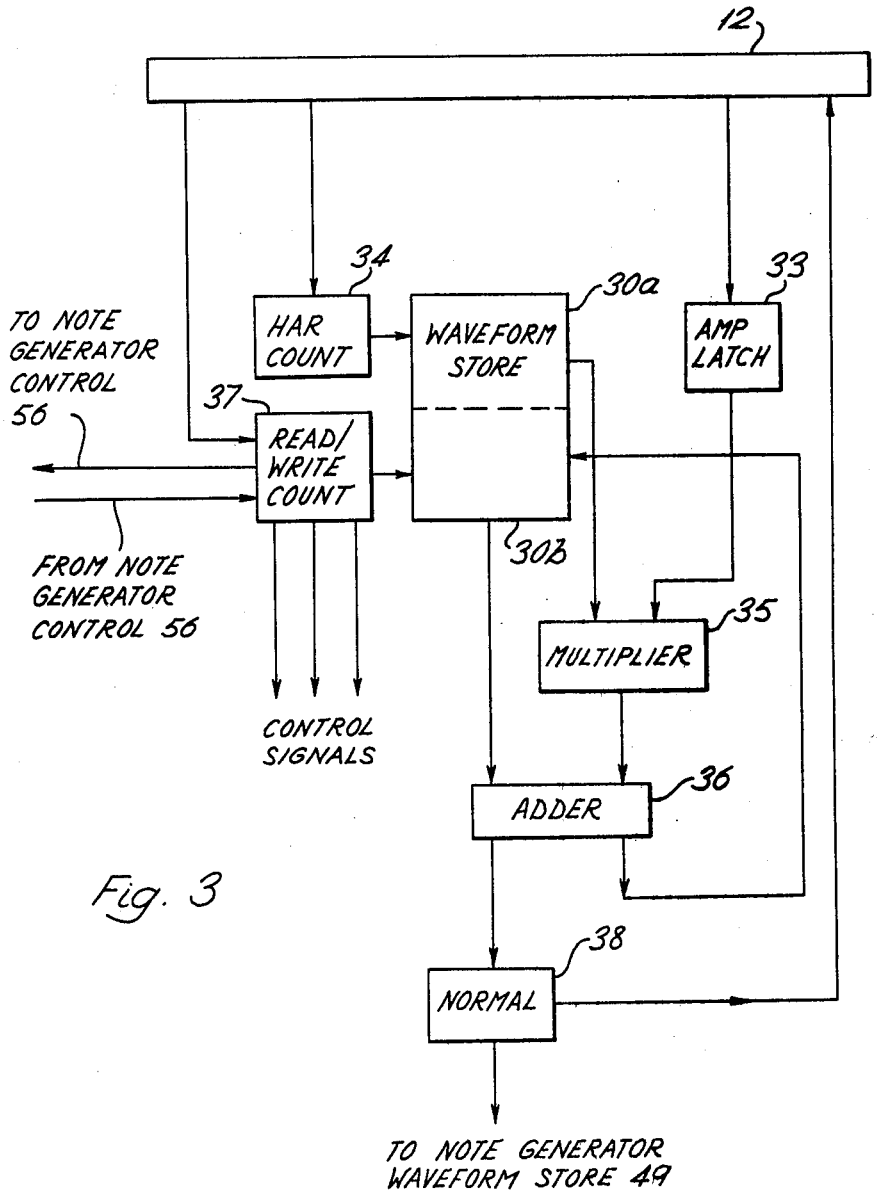
FIG. 3 is a schematic diagram of a waveform generator for the electronic organ of FIG. 1.

In the preceding description the waveform held in the store 49*a* is assumed to be static. In practice this will often be true for periods which may in fact be short but which represent the production of a large number of cycles of the waveform. It is, however, an important feature of the invention that at frequent intervals the stored waveform can be modified by new data from the waveform store 30 (FIG. 3). It was explained in connection with the incrementing of the pitch counter 51 that similar counters in each of forty channels operated sequentially during a sub-cycle of 800 ns within a cycle of 32 μs. This cycle time therefore allows no free sub-cycle periods for waveform loading. Counter 58 is however enabled to enter new data to the store 49 during any sub-cycle in which the stored waveform passes through zero.

For simplicity the operation of the musical note generator 14 has been described with reference to a single reading channel. It will be apparent that any number of the forty channels provided by the registers 51, 52, 53 and 54 can be operated independently to produce simultaneous notes. These notes may be based on the waveforms held in any one or more of the stores 49 since there is no fixed relationship between particular channels and the stores which they may address. Since the channels are operated in sequence there is initially an interval of 32 μs between the outputs from the first and the fortieth channel but the outputs from all channels are later superimposed.

The single waveform samples derived from each of the channels in use during a single cycle of the pitch counter 51 will thus eventually constitute a single point on a composite output waveform but have first to be scaled in amplitude individually. The samples are output in sequence from the stores 49 via the interpolater 65 (to be described later) to a shifter 72.

Scaling is produced by the combined operation of the shifter 72 and an adder-accumulator 73 to both of which amplitude control data is directed from the register 53 via buffers **60*b* and 61. The control range extends over one hundred and twenty seven logarithmic steps in amplitude and the data from register 53 determines the step allotted to the sample point derived from a particular channel at a particular time. The value held in the adder-accumulator 73** at the end of a system cycle is the cumulative total of individual amplitude steps for all the channels which were in use during that cycle.

This value of amplitude must be converted from digital to analogue form for presentation to the audio system and is preferably normalised before conversion. The need for this step arises because whereas digital storage capacity is relatively cheap the cost of a digital-to-analogue converter rises very steeply with capacity. A 12-bit converter is considered to represent a reasonable limit and inputs to it must be within this capacity. The adder-accumulator 73 is of 24-bit capacity and normalisation is necessary to minimise loss of data in transfer to a converter. The number of places to be shifted is specified by the computer 12 via a normalisation control 74 and simultaneously the data is issued to a gain control unit 75. As was explained in connection with the initiation of changes in amplitude and waveform store selection data in the registers 53, 54, changes in gain and normalisation data must only be issued when the quantity affected by the change is at or near zero. The computer instruction is therefore held in a buffer 76 and released only when a change permit signal is received by the normalisation and gain control units 74, 75. After normalising, the total from the adder/accumulator 73 is output via a 12-bit buffer 77 to a 12-bit digital-to-analogue converter 78. The analogue output from the converter 78 is incorrectly scaled in amplitude as a result of the normalisation procedure but is attenuated by a precisely corresponding amount in a multiplying digital-to-analogue converter 79. For this purpose, a gain compensation factor derived from the gain control unit 75 is applied to the multiplying input of converter 79. The analogue output from the converter 79 defines a voltage level which represents the amplitude of the desired composite waveform for the duration of one instrument cycle. When only the basic frequency of the sampling system is present the level will step by a small amount after each 32 μs to complete one cycle of the output frequency in 256 steps. For an output frequency below the basic frequency the number of steps/cycle will be greater than 256 and for very high frequencies the number will be much less. Following amplification in an amplifier 81, the composite waveform is passed to a loudspeaker 82.

The spatial distribution of sound sources in a pipe organ is unrealistically simulated by a single loudspeaker or by an array of loudspeakers each receiving the same signal. The impression received can be greatly improved by using two or more independent audio channels and the system as described can be readily adapted by including in the data provided to each amplitude and waveform register 53 an instruction specifying to which channel the output is to be directed. Alternatively, a part of the capacity of the musical note generator 14 may be allocated to each audio channel. For example in the output stages indicated as optional features by the chain-line connections in FIG. 4 the operations already described for the first channel would be repeated in a second channel. Thus a normalisation instruction is held in a buffer 86 for release to the normalisation control 74 and to a gain control unit 85. After normalising, the total from adder/accumulator 73 is output via a buffer 87 to a digital-to-analogue converter 88. The analogue output from converter 88 is attenuated in a multiplying digital-to-analogue converter 89 which receives the required attenuation factor from the gain control unit 85. The output from converter 89 is amplified by an amplifier 91 for reproduction at a loudspeaker 92. The stages 85 to 92 are similar to the stages 75 to 82.

The generation of the output waveform has been considered in detail in order to make clear that it may be of any desired pitch within the extremes of the audible range and that the harmonic structure is capable of being varied widely regardless of pitch. It is also necessary to consider the transient effects which distinguish one instrument from another to the listener. The rate of rise in amplitude ("attack") when a pipe begins to sound and the rate of fall ("decay") when excitation ceases are important characteristics of the pipe and of other instruments which may be simulated. It will be apparent that the amplitude controls described will provide all the necessary facilities for executing any programmed rate of change in the amplitude envelope such as may be required for attack, decay or tremolo effects. Similarly, vibrato within any required frequency excursion is easily obtained by varying the increment rate of the pitch counter 41. A further characteristic of the pipe organ is the initial transient known as the 'chiff'. This is a short burst of energy at some harmonic frequency which is prominent during the build-up of the fundamental tone and the general harmonic pattern of a pipe. Other transients characteristic of pipes, plucked strings and other forms of excitation can be produced.

Emphasis has been placed in this specification on the need to reproduce notes from different positions on the keyboard with the appropriate harmonic structure. In order to explain one way in which this result is achieved in carrying out the invention, the construction and operation of an organ has been described in which a waveform is generated ab initio in response to each key change. In practice advantage can be taken of the fact that, for a given stop, the changes in harmonic structure along the keyboard are smoothly progressive. The following procedure employing linear interpolation between fixed points has given very satisfactory results and involves less time in computation.

As soon as the initial stop selection is made, waveforms are synthesised in the way described which precisely correspond for that stop, to a number of positions on each keyboard. Thus, in a simple example, four notes C at octave spacings might be chosen for each manual and a single C for the pedal keyboard. The nine waveforms are held in the waveform stores 49 unaltered until a stop change is made. When this occurs the waveforms affected are replaced by waveforms newly generated to correspond to C in the new stop. If a note C is to be played the waveform from the appropriate store is directly read out by sampling in the way described. If however the required note is intermediate between two of the stored C's, then both C's are read out but for each pair of sample values an intermediate value is derived, weighted towards the upper or lower value according to the relative position of the note. This intermediate value is a close approximation to the sample value which would have been obtained from a waveform specific to the note concerned and is processed for audio reproduction in the way described with reference to FIG. 4. The intermediate value is derived in the interpolation unit 65 which is connected between the output from the waveform stores 49 and the shifter 72.

It will now be clear that the interpolation unit 65 performs two functions. First, an intermediate value can be derived between the sample values obtained from two adjacent addresses in a single waveform store when the notional address lies between them. Second, as described in the preceding paragraph, an intermediate value can be derived between the sample values obtained from corresponding addresses in two waveform stores when the required waveform is related to each of the two stored waveforms. A block diagram of the unit 65 is shown in FIG. 6 but is to be read in conjunction with the data/control inputs to unit 65 which are shown in FIG. 4. It will be recalled that, during each time interval of 800 μs, values are read out for single channel from the address indicated in the pitch counter 51 and from the next higher address. An interpolation store 66 comprises two memories 66A and 66B which receive the pair of sample values output from waveform store 49. The location of each sample in store 66 is controlled by a signal from the waveform register 53 via the output buffer **60*a* and a further delay buffer 64. The data is divided between memories A and B of store 66 such that the sample from the lower address of the pair is held in memory A and the sample from the higher address is held in memory B. In order to apply the appropriate weighting factors to the stored values the first value is read from memory 66A into a multiplier 67A and the second value from memory 66B into a multiplier 67B. The top four bits from the increment store of the pitch counter 51 are entered via a delay buffer 68 into multiplier 67A, then subtracted from sixteen and the resultant divided by sixteen and multiplied by the first sample value. Simultaneously, the same four bits are entered in multiplier 67B, multiplied by the second sample value and divided by sixteen. The outputs from multipliers 67A and 67B are summed in an adder/accumulator 69 to give the required intermediate value. If waveform interpolation is to be carried out this value is further multiplied in an adder 70 by a weighting factor (p) instructed by the computer 12 via register 53 and the product is held in adder/accumulator 71. The whole of the preceding process for deriving an intermediate value is then repeated for the pair of sample values from the related channel but this intermediate value is multiplied in adder 70 by a weighting factor (16-p). The product is added to the value held in adder/accumulator 71 and the sum is output from the unit 65**. It is of course immaterial that the interpolation procedure will sometimes be followed when one of the pair of sample values is already exact. This value will be preserved since the weighting factor applied to the other value will be zero.

Interpolation between two waveforms availabe in store by means of the unit 65 can be performed in the same time-interval as would otherwise be used for a single-sample read-out. It is therefore advantageous in speed as compared with the equally valid analogous software method by which the specification for an interpolated waveform might be prepared in the computer from stored data on two adjacent waveforms. Some significant delay is then inevitable in performing the additional computation followed by harmonic synthesis.

In the design of the computer 12 advantage is taken of recently-available microcircuits such as the Zilog Z 80A single chip microprocessor with associated RAM and ROM chip stores but the facilities required are familiar to those skilled in the computer art and may be provided in any convenient form. For the same reason it is not considered helpful to specify particular commercial forms of the well-known digital circuit elements which are shown in the block diagrams.

It will also be apparent that the functions contributing to the operation of the instrument described may be shared between the computer and the hardware of the instrument in ways which differ to some extent from that described without departing from the concept of the invention. By way of illustration the program of the computer 12 as it operates in the system described will be given in outline.

In the flow diagrams of FIGS. 5(*a*) to (*e*) and in descriptive references to them the following abbreviations appear:

GENs—the forty waveform reading channels of the note generator 14 of FIG. 1

CG—a routine for checking the state of the GENs and making any changes which are required WVS—the waveform stores 49 (FIG. 4) of the note generator 14 of FIG. 1

KCH—a routine for responding to changes in the state of key and stop contacts.

The control program uses the following tables for working storage:

GENs: for every generator channel the following information is stored:

1. Flags [UPDATE, CHIFF, ATTACK, DECAY, IN USE]
2. Pitch
3. Chiff parameters (a) duration
(b) harmonic to be sounded first
4. Amplitude parameters
(a) maximum (steady state) value
(b) current value
(c) attack rate
(d) decay rate
5. WVS number
6. Identification:
(a) manual number
(b) key number WVS: for every waveform store:
1.
(a) manual number
(b) key number for which the waveform is correct
2. The number of GENs using this store
3.
(a) maximum amplitude
(b) attack rate
(c) decay rate FIG. 5(*a*) shows the flow diagram for the main program which first initialises all the working storage tables (Block M1). The generators are all set free and the IN USE flag is cleared. WVS entries are initialised to represent several groups of keys on each manual, so that when a key is first pressed there is an approximately correct waveform ready to be used. After the interrupt system is enabled, console interrupts from stops and keys will cause GENs and WVSs to be updated. In Block M2 the main program checks the STOPS CHANGED flag, and, if set, calculates new waveforms for those WVSs affected. In Block M3 may spare WVS is used to reduce the error caused by using in one part of the keyboard a waveform calculated for another part of the keyboard. Blocks M1, M2 include control of the generation of reference waveforms and their loading into WVS stores.

The clock interrupt routine shown in FIG. 5*b* is entered every time an interrupt occurs from a clock which operates at intervals of about 4 ms. All commands to the note generator which relate to amplitude (including attack, decay and normalisation) are issued from this routine. Small random changes are made in pitch and amplitude to ensure that notes shall not be locked in phase. The sub-routine CG for checking and updating GENs is shown in FIG. 5*c*. When decay is complete in any channel the IN USE flag is cleared and the count of GENs using the associated WVS is reduced by one.

The console interrupt routine shown in FIG. 5*d* refers to the operation of the interrupt circuit 25 of FIG. 2. Stop changes cause the STOPS CHANGED flag to be set, and the STOP table, which contains the current state of each stop, to be updated. The sub-routine KCH shown in FIG. 5*e* is used to initiate and terminate notes.

For convenience and in order to clarify the operation and to demonstrate the versatility of the invention an electronic organ has been described. It will be apparent, however, that the invention may be applied to provide other forms of single-note or multiple-note instrument in which the digital data representing a desired reference waveform is generated within the instrument with means for reproduction by sampling at a selected incremental rate.

For purposes of practice or instruction for example, the organ provides a facility for interfacing with the computer a digital cassette recorder. The computer instructions for music played in via the keyboards can then be digitally recorded in the form of the outputs from the key and stop contact multiplexer together with identification words and clock times. The speed of playback can then be varied as desired so that, for example, a difficult piece of music can be recorded slowly and played back at the correct speed.

Data are recorded on tape in teletype format, a teletype sender/receiver chip being used to provide the necessary serial/parallel conversion between the recorder circuits and the computer and to provide timing.

Data from tape may also be input to the computer to change the specification of the organ by changing the tonal characteristics of the stops and to program the computer for the simulation of other instruments.

In describing details of the design and operation of the instrument, values have been indicated for parameters such as process times and store capacities. Such values are intended only to indicate current practice and not as introducing any restriction on the scope of the invention. For example the sampling capacity of the instrument can be increased to any desired extent by using more than one block of forty sampling channels.

I claim:

1. A digital generator for musical notes comprising means for producing selection signals each of which indicates the selection of a defined set of a plurality of harmonic structures, each structure being associated with at least one note in dependence on the pitch of the note, and means for producing further selection signals each of which indicates the selection of a note having a predetermined pitch and a predetermined harmonic structure within a selected one of said sets, digital computing means programmed to be responsive to each selection signal to produce harmonic data and control signals, storage data and control signals and sample-selection data and control signals, synthesising means responsive to the harmonic data and control signals for synthesising digital data representing reference waveforms, means responsive to the storage data and control signals for storing the reference waveform data and sampling means responsive to the sample-selection data and control signals for selectively sampling the stored reference waveform data to so derive further digital data representing the predetermined harmonic structure of the selected note that the structure is selected from one of the said defined sets in accordance with the pitch of the selected note, the rate of sampling being effective to determine the pitch of the note when the note is reproduced from the further digital data.

2. A digital generator according to claim 1 in which the means for producing the selection signals and further selection signals includes means for changing the status of selected ones from an array of selection indicators to indicate selection, means for repetitively scanning the array to determine the status of each indicator, and comparator means for comparing the status of each indicator in successive scans to produce one of said selection signals whenever said change of status occurs.

3. A digital generator according to claim 1 in which the synthesising means includes means for storing initial digital synthesis data representing a sinusoidal waveform, means for deriving from the initial synthesis data further digital synthesis data representing in relative frequency and relative amplitude each constituent harmonic of predetermined ones of said selected set of harmonic structures and means for superimposing the initial synthesis data and the further synthesis data to represent the reference waveforms corresponding to said ones of said set of harmonic structures.

4. A digital generator according to claim 1 in which the means for storing the reference waveform data includes means for normalising said waveform data to enable the most significant portion of said waveform data to be accommodated in a store of minimum capacity.

5. A digital generator according to claim 1 in which the sampling means includes address selection means for addressing a store containing a reference waveform to derive a sample value in each of a sequence of uniformly-spaced time intervals from the address indicated by the selection means in that interval, the selection means including counting means arranged to receive an input count increment in each of said time intervals and further arranged to cause the selection means to advance from an indicated address to the next adjacent higher address in response to a predetermined cumulative input count, the sequence of sample values being produced at a rate which enables the note having a structure represented by the reference waveform to be reproduced at a pitch in proportion to the ratio of the input count increment to the predetermined cumulative input count.

6. A digital generator according to claim 5 in which the address selection means is further adapted to derive in each said time interval a sample value from the address next higher to that indicated by the selection means, the sampling means including means for deriving said sequence of sample values such that each said sample value is intermediate between the sample values derived respectively from the indicated address and from the next higher address, the intermediate value for each time interval being obtained by interpolation according to the ratio of the cumulative input count at that interval to the predetermined cumulative input count.

7. A digital generator according to claim 5 so arranged that one said sequence of sample values is derivable from a first reference waveform and a like sequence of sample values is derivable from a second reference waveform of the same set as the first reference waveform, including means for deriving an intermediate value between each value in the one sequence and the corresponding value in the other sequence, the intermediate values being obtained by interpolation to represent a note having an harmonic structure intermediate between the harmonic structures of the first and second reference waveforms.

8. A digital generator according to claim 5 in which the sampling means comprises a purality of sampling channels operative in sequence during respective ones of a cyclic succession of said time intervals together constituting a sampling period, each channel including one of said address selection means, and accumulator means for superimposing in each sampling period the further digital data derived during each said time-interval of that sampling period to represent the amplitude of a composite waveform during each such period.

9. A digital generator according to claim 1 including means for assigning a respective value on a scale of relative amplitude to the further digital data representing each selected note.

10. A digital generator according to claim 1 further comprising converter means for converting the further digital data to an analogue signal.

11. A digital generator according to claim 10 including means for normalising the digital data prior to converting to enable the most significant portion of the data to be accommodated in a converter of minimum capacity and means for restoring in the analoque signal the scale of relative amplitude assigned to the corresponding digital data before normalising.

12. A digital generator according to claim 1, further including means for audio reproduction of the selected note.

13. A digital generator according to claim 12 in which the means for audio-reproduction comprises a plurality of channels to which selected portions of the further digital data may be respectively assigned.

14. A digital generator according to claim 1 for operation as an electronic organ, the means for producing said selection signals including a plurality of stops and the means for producing said further selection signals including a plurality of keys.

15. A digital generator according to claim 14 including means for subjecting the further digital data representing each selected note to transient variations in amplitude to reproduce the effects of attack and decay characteristic of the organ.

16. A digital generator according to claim 5 in which the input count increment is enabled to be varied systematically over a narrow range about an assigned mean value.

17. A digital generator according to claim 5, in which the input count increment is enabled to be varied randomly over a narrow range about an assigned mean value in each of a plurality of channels of the sampling means such that, when a note of the same pitch is to be reproduced from each of a related plurality of reference waveforms, random phase changes are caused to appear between the notes.

18. An electronic organ comprising:

digital computer means having first input means including a plurality of organ stops for producing first selection signals each of which indicates the selection of a set of harmonic structures, and second input means including a plurality of organ keys for producing second selection signals each of which indicates the selection of a note having a predetermined pitch and a predetermined harmonic structure lying within a selected set, synthesizing means under the control of said digital computer means and responsive to a change in said first selection signals for generating a plurality of digital sample values comprising amplitude samples for plural musical waveforms representing different pitches within a set of harmonic structures, including the addition of selected harmonic components for making up said waveforms in response to a change in said first selection signals, storage means for receiving and storing said plurality of sample values, sampling means controlled by said digital computer means for addressing and reading out at a predetermined rate from said storage means ones of said sample values in accordance with said second selection signals, and means for converting the sample values read out into a continuous analog musical output.

19. The organ according to claim 18 wherein said synthesizing means includes means for storing initial digital synthesis data representing a sinusoidal waveform, means for deriving from the initial synthesis data further digital synthesis data representing in relative frequency and relative amplitude each constituent harmonic of a said selected set of harmonic structures and means for superimposing the initial synthesis data and the further synthesis data to represent the digital sample values corresponding to said waveforms.

20. The organ according to claim 18 wherein said sampling means includes means for deriving intermediate values between sample values of a first said waveform and the corresponding sample values of a second said waveform, the intermediate values being obtained by interpolation to represent a note having a harmonic structure intermediate between the harmonic structures of the first and second waveforms.

21. The organ according to claim 18 wherein said sampling means comprises an increment register for receiving an increment value indicative of pitch from said digital computer means, a pitch counter for addressing said storage means, and adder means for successively adding the increment value from said increment register to said pitch counter to provide successive addresses for addressing said storge means, wherein increments representing higher pitches produce selection of fewer than all the samples representing a given waveform while passing over intermediate samples to produce an output of higher frequency.

22. The organ according to claim 21 wherein said sampling means comprises a plurality of sampling channels operative in sequence during respective ones of a cycle succession of time intervals together constituting a sampling period, each channel including a said increment register, a said adder means and a said pitch counter for bringing about addressing of said storage means, and accumulator means for superimposing in each sampling period the digital data derived during each such time interval to represent the amplitude of a composite waveform during each such period.

23. The organ according to claim 18 in which the means for converting said samples into continuous analog output comprises a plurality of channels to which selected portions of output data are respectively assigned.

24. A generator for musical notes comprising:

digital computer means having first input means including a plurality of stops for producing first selection signals each of which indicates the selection of a set of harmonic structures, and second input means including a plurality of keys for producing second selection signals each of which indicates the selection of a note having a predetermined pitch and a predetermined harmonic structure lying within a selected set, synthesizing means under computer control for generating a plurality of digital sample values comprising amplitude samples for plural musical waveforms including the addition of harmonic components in response to said first selection signals, wherein said plural waveforms correspond to a selected set of harmonic structures but with individual waveforms differing in respect to harmonic structure by virtue of modified harmonic component addition in accordance with differing pitch represented by the waveforms along a musical scale such that a waveform representative of a low frequency has greater harmonic content than a waveform representative of a higher frequency, storage means for receiving and storing said plurality of digital sample values, sampling means responsive to said second selection signals for reading out at a predetermined rate from said storage means ones of said sample values corresponding to at least one said musical waveform related in pitch along said musical scale to an operative second selection signal, and means for converting the sample values read out into a continuous analog musical output.

25. The generator according to claim 24 wherein sample values for fewer musical waveforms are generated and stored than would provide a waveform for each organ key along a said musical scale, and wherein said sampling means includes means for interpolating between sample values representative of a pair of musical waveforms respectively above and below an operative second selection signal along said musical scale.

26. The generator according to claim 25 wherein said interpolating means provides linear interpolation between sample values.

27. The generator according to claim 24 wherein said synthesizing means includes means for receiving successive samples of a waveform at different harmonically related frequencies, and means for adding said samples according to the amplitude of respective harmonic components selected by said digital computer means to produce a composite waveform representation.

28. A generator for musical notes comprising:

keyboard means including stop means for producing selection signals each of which indicates the selection of a defined set of harmonic structures, and key means for producing further selection signals each of which indicates the selection of a note having a predetermined pitch and a predetermined harmonic structure lying within a selected set, storage means for storing a plurality of digital samples representing a plurality of waveforms for a selected set of harmonic structures, wherein said plurality of waveforms vary in harmonic content and represent differing pitches along a musical scale with there being fewer of said waveforms than there are notes in the corresponding musical scale, and keyboard controlled means for sampling the samples in said storage means in response to selection of key means for selecting a note including means for interpolating between samples of a pair of said waveforms when the pitch of the note selected by said key means lies between said pair of said waveforms along said musical scale, and means for converting the samples read from said storage means into a continuous analog output.

29. The generator according to claim 28 further including means for interpolating between successive samples read from the same waveform in said storage means.

* * * * *